US010406550B2

(12) United States Patent
Volonte

(10) Patent No.: US 10,406,550 B2
(45) Date of Patent: Sep. 10, 2019

(54) POWDER COATING BOOTH, POWDER COATING INSTALLATION AND METHOD FOR OPERATING THE POWDER COATING BOOTH

(71) Applicant: Wagner International AG, Altstatten (CH)

(72) Inventor: Alessio Volonte, Valmadrera (IT)

(73) Assignee: Wagner International AG, Altstatten (CH)

( * ) Notice: Subject to any disclaimer, the term of this patent is extended or adjusted under 35 U.S.C. 154(b) by 0 days.

(21) Appl. No.: 15/839,246

(22) Filed: Dec. 12, 2017

(65) Prior Publication Data

US 2018/0161797 A1 Jun. 14, 2018

(30) Foreign Application Priority Data

Dec. 14, 2016 (EP) ..... 16204183

(51) Int. Cl.
*B05B 15/50* (2018.01)
*B05B 15/522* (2018.01)
(Continued)

(52) U.S. Cl.
CPC ..... *B05B 15/50* (2018.02); *B05B 14/41* (2018.02); *B05B 14/45* (2018.02); *B05B 14/48* (2018.02);
(Continued)

(58) Field of Classification Search
CPC ..... B05B 15/50; B05B 16/40; B05B 14/48; B05B 14/41; B05B 14/45; B05B 15/522;
(Continued)

(56) References Cited

U.S. PATENT DOCUMENTS 5,690,995 A 11/1997 Fischli et al.
2002/0050245 A1* 5/2002 Kramer ..... B05B 16/405 118/70
(Continued)

FOREIGN PATENT DOCUMENTS

DE 10 2006 055688 A1 6/2007
EP 0 721 804 A2 7/1996
(Continued)

OTHER PUBLICATIONS

Extended European Search Report for corresponding European Application No. 16204183.4 dated Jul. 25, 2017.

*Primary Examiner* — Laura Edwards
(74) *Attorney, Agent, or Firm* — Renner, Otto, Boisselle & Sklar, LLP

(57) ABSTRACT

A powder coating booth includes booth walls and a roof which can be lowered between the booth walls, wherein a gap is provided between the roof and the booth walls. The roof has compressed air nozzles for spraying the booth walls. In addition, a supporting device is provided, which supports the roof. In at least one of the booth walls a vertical slot is provided through which the supporting device protrudes into the booth and in which the supporting device is movable. In addition, the booth includes a bottom (19) with a suction, which is connectable with the suction inlet of a cyclone separator via a suction pipe.

18 Claims, 13 Drawing Sheets

(51) Int. Cl.

| | |
|---|---|
| ***B05B 15/65*** | (2018.01) |
| ***B05B 15/62*** | (2018.01) |
| ***B05B 15/68*** | (2018.01) |
| ***B05B 14/48*** | (2018.01) |
| ***B05B 16/40*** | (2018.01) |
| ***B05B 14/45*** | (2018.01) |
| ***B05B 14/41*** | (2018.01) |
| *B05B 13/04* | (2006.01) |
| *B05B 16/00* | (2018.01) |

(52) U.S. Cl.
CPC ..... *B05B 15/522* (2018.02); *B05B 15/62* (2018.02); *B05B 15/65* (2018.02); *B05B 15/68* (2018.02); *B05B 16/40* (2018.02); *B05B 13/0405* (2013.01); *B05B 16/90* (2018.02)

(58) Field of Classification Search
CPC ..... B05B 15/65; B05B 15/68; B05B 15/62; B05B 13/0405; B05B 16/90; B05B 15/12; B05B 16/80; B05B 16/405; B05C 15/00; B05C 19/00; B05C 19/008; B05C 19/04; B05C 19/06; A47L 11/4044; B08B 15/02
USPC ..... 118/326, 308
See application file for complete search history.

(56) References Cited

U.S. PATENT DOCUMENTS

2010/0175616 A1 7/2010 Shutic et al.
2015/0027365 A1* 1/2015 Shutic ..... B05B 14/44 118/326

FOREIGN PATENT DOCUMENTS

EP 1 319 442 A1 6/2003
EP 2 368 643 A1 9/2011

* cited by examiner

POWDER COATING BOOTH, POWDER COATING INSTALLATION AND METHOD FOR OPERATING THE POWDER COATING BOOTH

TECHNICAL FIELD

The invention relates to a powder coating booth, a powder coating installation and a method for operating the powder coating booth.

In the electrostatic coating of workpieces with powder the powder is sprayed by means of one or more powder applicators on the workpiece to be coated. During the coating process, the workpieces to be coated are usually located within a powder coating booth, which in short is also referred to below as booth or coating booth. Since during the coating process not all of the powder particles sprayed by the powder spray applicators adhere to the workpieces to be coated, the excess powder, which is also referred to as overspray, must be removed from the booth. This is partly because the environment outside the booth is to be kept free of powder dust. On the other hand, the risk of explosion increases if a certain powder concentration is exceeded by the powder dust cloud floating in the booth. This should be avoided. During the coating operation, excess powder can only partially be suctioned off from inside the booth. In a color change, cleaning measures are required to remove the remaining powder from the booth, which takes time. If the booth is not sufficiently cleaned, it may cause undesirable color carryover after a color change.

Manual cleaning of the powder coating booth is known to take a relatively long time. During this time, the coating installation is not available for production. Another disadvantage of manual cleaning is that personnel are exposed to the risk of inhaling pollutants during cleaning.

PRIOR ART

Prior art US 2010/0175616 A1 discloses a powder coating booth, which is equipped with a device for automatic cleaning of the booth. On the side of the booth, there is arranged a suction duct with a vertical slot-shaped suction opening facing the inside of the booth. The duct and the suction slot extend over the entire height of the booth. At the level of the suction inlet of the cyclone separator, the suction duct is connected to the cyclone. In the booth bottom is a bypass opening, which is connected with an after filter via a bypass line. The powder coating booth has a lowerable roof that can be lowered into the booth via a series of cables. The roof carries compressed air tanks and nozzles that blow in the direction of the booth walls as the roof is lowered. The air is sucked through the suction slot into the suction duct. In the suction duct is a bulkhead, which closes the suction duct airtight upwards and which is moved together with the roof downward. As soon as the bulkhead is at the level of the intake opening of the cyclone, the bypass opening in the booth bottom is opened and the air is sucked into the after filter via the bypass line. This solution has the disadvantage that only a part of the overspray reaches the cyclone separator and can be recovered. The other part of the overspray goes directly into the after filter and thus, as waste, is no longer available for further coating processes. Since the two halves of the roof are suspended and lowered by cables, guide rollers are necessary to stabilize the halves of the roof. However, these rollers make the construction expensive. The rollers can also leave impressions on the booth walls and the booth walls can become electrostatically charged. This can lead to a strong adhesion of coating powder on the booth walls and to soiling of the booth walls. In addition, a soiled or blocked guide roller can leave scratches and marks on the booth wall, in which coating powder can accumulate.

SUMMARY OF THE INVENTION

An object of the invention is to provide a powder coating booth, a powder coating installation and a method for operating the powder coating booth, in which a fast and automated cleaning of the booth is possible.

Advantageously, the abovementioned disadvantages are avoided with the solution according to the invention. In the solution according to the invention, the booth roof does not touch the booth walls.

Advantageously, the color change is accelerated also by the quick cleaning of the booth. A further advantage is that the powder waste is minimized by the solution according to the invention.

The object is achieved by a powder coating booth with the features according to one or more aspects of the invention.

The powder coating booth according to one aspect of the invention comprises booth walls and a roof which can be lowered between the booth walls, wherein a gap is provided between the roof and the booth walls. The roof has compressed air nozzles for spraying the booth walls. In addition, a supporting device is provided which supports the roof. In at least one of the booth walls, a vertical slot is provided, through which the supporting device protrudes into the booth and in which the supporting device is movable. In addition, the booth comprises a bottom with a suction, which is connectable with the suction inlet of a cyclone separator via a suction pipe.

The powder coating installation according to another aspect of the invention comprises the above-described powder coating booth and a cyclone separator which is connected to the powder coating booth.

In the method according to another aspect of the invention for operating the booth it is provided that the slot between the first and the second roof panel is closed first before cleaning begins.

Advantageous developments of the invention are apparent from the features specified in the dependent claims.

In an embodiment of the powder coating booth according to the invention, a vertical guide for the supporting device is provided, which is arranged outside the spray coating space of the booth. This has the advantage that the vertical guide remains free of coating powder and thus does not get soiled during the coating operation.

In another embodiment of the powder coating booth according to the invention, the vertical guide for the supporting device is arranged laterally outside the spray coating space of the booth.

In a further embodiment of the powder coating booth according to the invention, the vertical slot is arranged in a corner of the booth. Instead of connecting and sealing the booth walls in the corner, the slot can be realized there in a simple manner.

In another embodiment of the powder coating booth according to the invention, the roof has a first roof panel and a second roof panel. At least one of the roof panels is horizontally movable. By sliding the roof panel during the cleaning operation, the gap in the roof, which is intended for the transport of the workpiece, can be reduced or completely closed. Thus, no or virtually no air passes through the transport gap from the booth during the cleaning operation.

During coating operation, the roof panels can be positioned to protrude at least partially over the booth walls. The roof panels can even rest on top of the booth walls. In this way, the gap between the roof and the booth walls can be minimized or even eliminated altogether.

In a development of the booth according to the invention, the compressed air nozzles are divided into several groups. The groups are independently operable. Thus, if necessary, one or more of the groups can be switched on or off.

In another development of the booth according to the invention, a drive is provided, by means of which the first roof panel is horizontally movable.

In an additional development of the booth according to the invention, a motor is provided by means of which the roof is vertically movable.

In addition, in the booth according to the invention, a passage for a powder spray applicator can be arranged in one of the booth walls. The spray applicator passage is arranged in the booth side wall in such a manner that it is at the largest possible distance to the slot provided for the supporting device. This has the advantage that the air that enters the booth during the coating operation through the spray applicator passage does not escape or only escapes through the slot to a limited extent.

In at least one of the booth side walls of the booth according to the invention, compressed air nozzles can be provided, wherein their blowing direction is directed at the spray applicator passage. This allows the spray applicator passage to be kept free of coating powder.

In the booth according to the invention, a sliding door can be provided, by means of which the spray applicator passage can be closed.

In the booth according to the invention, a door can be provided on the front side of the booth, in which compressed-air nozzles are arranged.

In the booth according to the invention it is also possible to provide a blow strip with several compressed air nozzles, which is arranged at the booth bottom.

Finally, the compressed air nozzles of the blow strip can be divided into several sections in the booth according to the invention. The sections are formed such that they can be operated independently of one another.

In a development of the method according to the invention, the roof is moved downwards thereby blowing compressed air in the direction of the booth walls by means of the nozzles.

BRIEF DESCRIPTION OF THE DRAWINGS

In the following, the invention will be explained in more detail by means of several exemplary embodiments with reference to 15 FIGS.

EMBODIMENTS OF THE INVENTION

Figure 1:
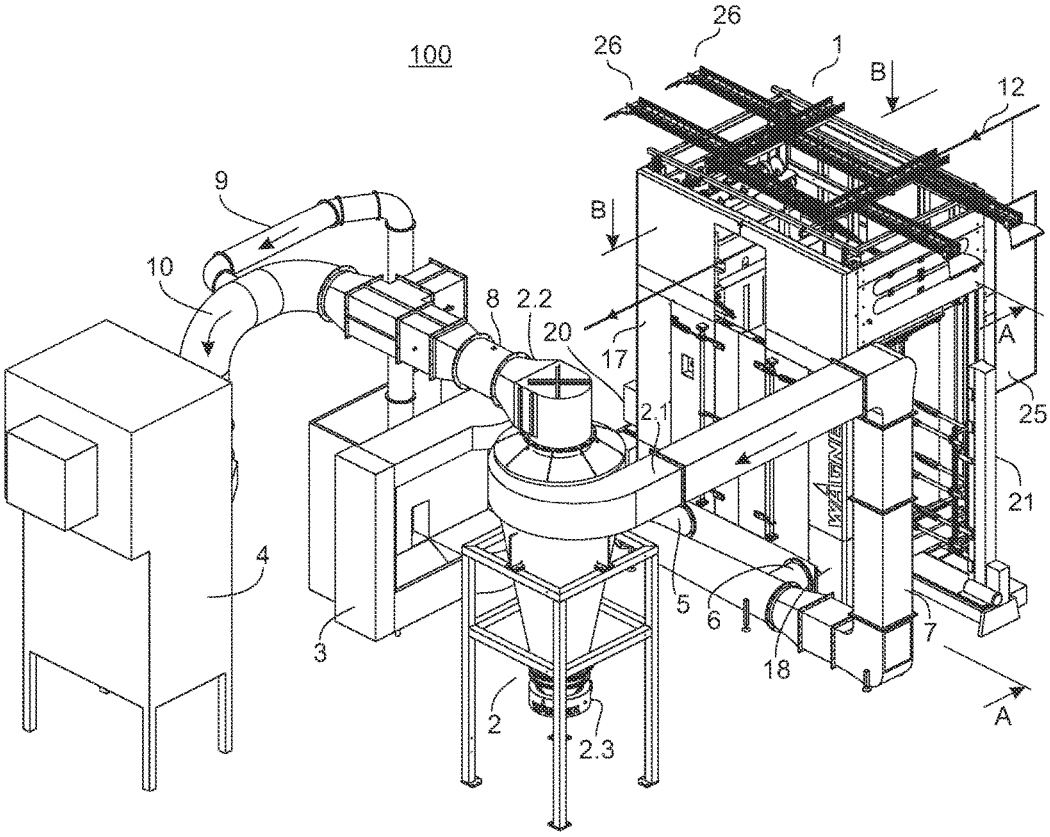
FIG. 1 shows a possible embodiment of the powder coating installation according to the invention in a first three-dimensional view.
Figure 2:
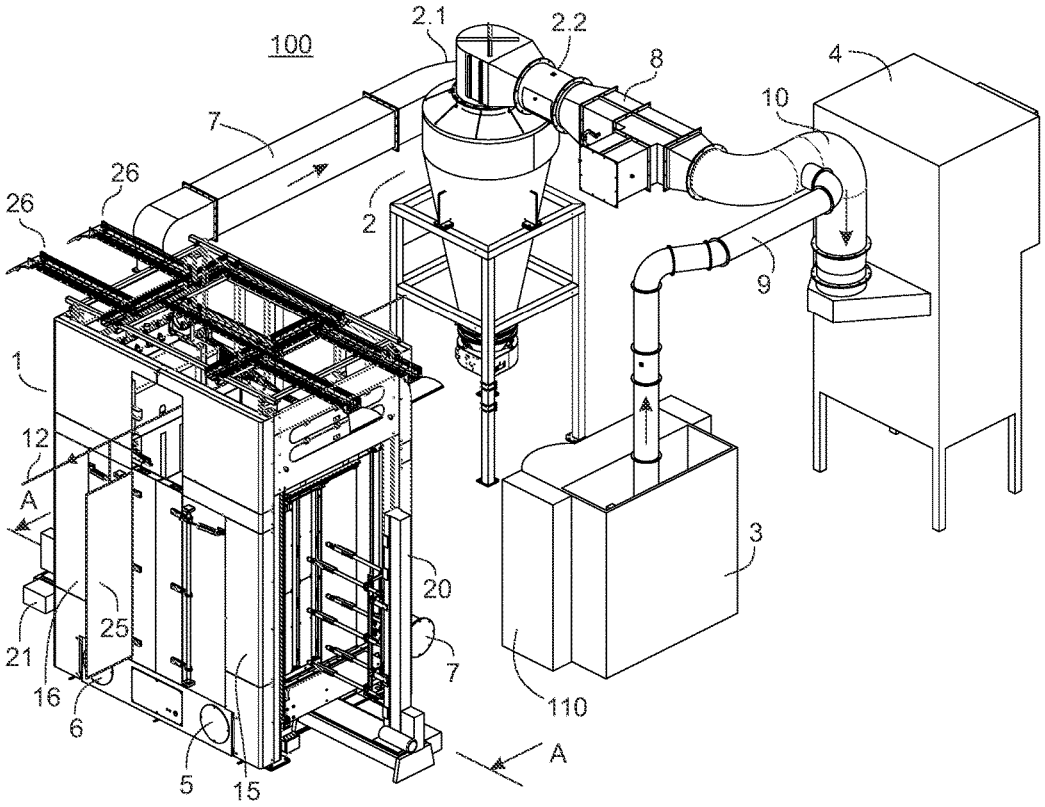
FIG. 2 shows the powder coating installation according to the invention in a second three-dimensional view.

FIGS. 1 and 2 show a possible embodiment of the powder coating installation 100 according to the invention in three-dimensional view from two different perspectives. The powder coating installation 100 comprises a powder coating booth 1 and a cyclone separator 2 connected to the powder coating booth 1.

In order to remove it from booth 1, the overspray together with the air in the booth is suctioned as powder-air mixture from booth 1 via two suction lines 5 and 6 and fed to cyclone separator 2 via a suction line 7. This can be configured for example as a monocyclone. Such a cyclone separator, or cyclone in short, is known from publication EP 1 319 442 A1. The powder-air mixture flows tangentially into cyclone 2 via a suction inlet 2.1 and in the cyclone spirally downwards. Hereby, the powder particles are pressed outwards to the outer wall of cyclone 2 by the centrifugal force arising during the rotation of the powder air flow. The powder particles are conveyed downwards in the direction of powder outlet 2.3 of cyclone 2 and collected there. The air freed from the powder particles is suctioned through a central pipe located in cyclone 2 via a powder pump and exits the cyclone via an outlet 2.2.

The air flow thus cleaned is then fed to a post filter 4 via suction lines 8 and 10 to filter out the residual powder remaining in the air. Powder coating installation 100 may also comprise post-filter 4 for this purpose. Unlike cyclone 2, after filter 4 is operated in loss mode. This means that the powder filtered out in the after filter 4 is not fed back to the coating process, but it is disposed of. In after filter 4 is the vacuum generation for cyclone 2.

Usually, the overspray suctioned from booth 1 is recovered and used again for workpiece coating. In this case, cyclone 2 is placed upstream of post filter 4. In this way, the overspray is suctioned from booth 1 via suction ducts 5, 6 and 7 and recovered in cyclone 2.

On the other hand, in the event that coating installation 100 is to be operated in loss mode, a cyclone is dispensed with and suctioned directly via after filter 4. In this way, the overspray is suctioned from booth 1 via suction lines 5, 6, 7, 8 and 10 and filtered out in after filter 4. There is also the possibility that the powder pump below the cyclone 2 conveys directly to post filter 4 in loss mode. The overspray filtered out by means of post filter 4 is no longer used for coating. Operating coating installation 100 in loss mode may be advantageous if frequent color changes take place.

The powder coating installation can also have a powder center 3. Control 110 for the installation may be located in or at powder center 3, for example. Powder center 3, which comprises a powder supply equipment and often also its own ventilation, is located in the present exemplary embodiment between cyclone 2 and post filter 4. Powder center 3 can be connected to post filter 4 via a suction line 9. This is particularly advantageous for cleaning the powder supply equipment. Via powder center 3, powder spray applicators 22 (see FIG. 3) are supplied with powder via powder supply lines. The powder supply lines used for this purpose are not shown in the figures. They can be routed to the powder applicators 22 via cable ducts 26 arranged above booth 1. Cable ducts 26 may also serve to receive electrical lines, such as power cables and control lines.

Powder spray applicators 22 or, in short, powder applicators may be, for example, automatic spray guns or manually operated powder spray guns. For automatic spray coating, the powder applicators may be attached to one or more linear lifters 20 and 21. Linear lifters 20 and 21 are located laterally adjacent to booth 1 and on bottom 11 just like booth 1. Using linear lifters 20 and 21, the powder applicators 22 can be moved together up and down, that is, along the y-axis. In addition, using linear lifters 20 and 21, powder applicators 22 can also be moved along the z-axis and thus into and out of booth 1. Powder applicators 22 are arranged so that a workpiece 25, which is moved by a conveyor 12 through booth 1, can be coated using the same. For this purpose, booth 1 has openings for workpiece 25 on its front sides and openings for powder applicators 22 on its longitudinal sides. One front side of booth 1 is formed by booth side walls 15, 16 and the other front side is formed by booth side walls 17, 18 (see FIGS. 1 and 2). The longitudinal sides of booth 1 are formed by booth side walls 13 and 14 (see FIG. 3). Conveyor 12 is represented in the figures only sketchily.

Figure 3:
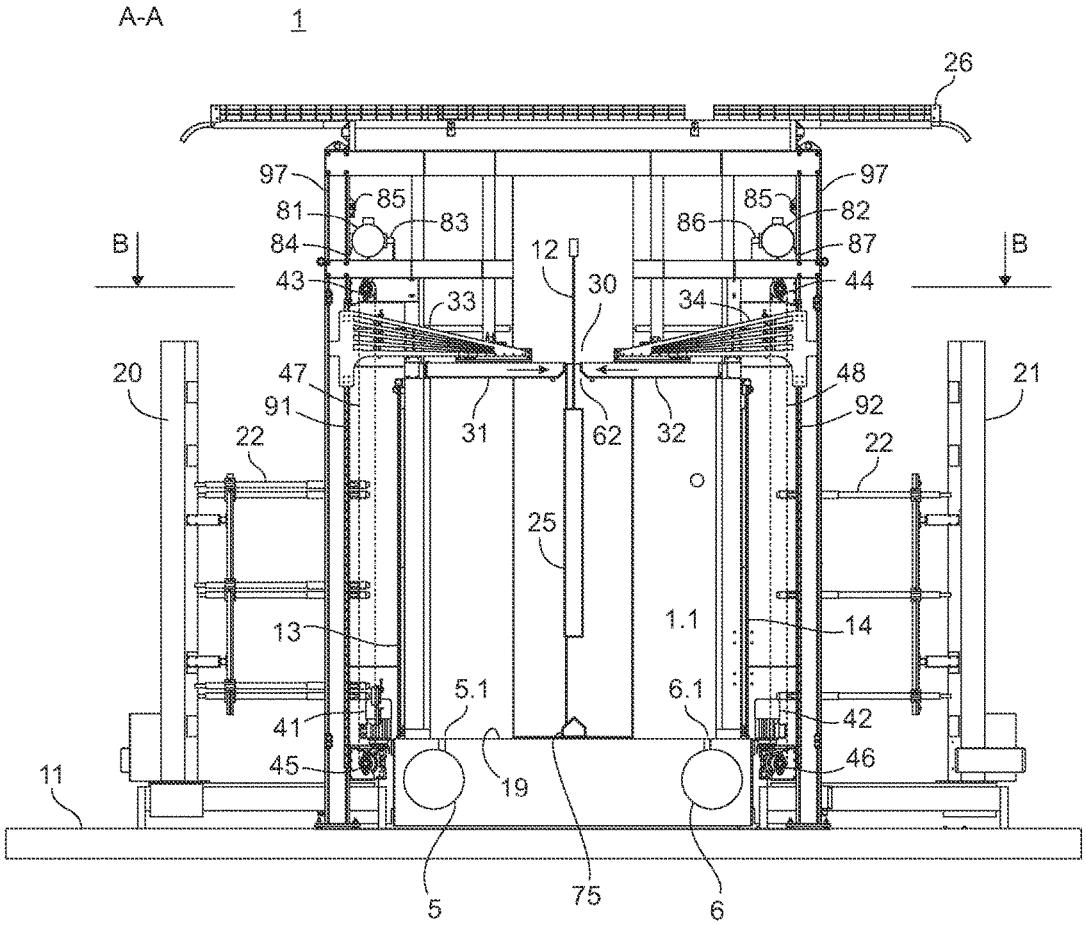
FIG. 3 shows a possible embodiment of the powder coating booth according to the invention in sectional view with the roof in the upper position. The two roof panels of the roof are still in their outer positions.
Figure 4:
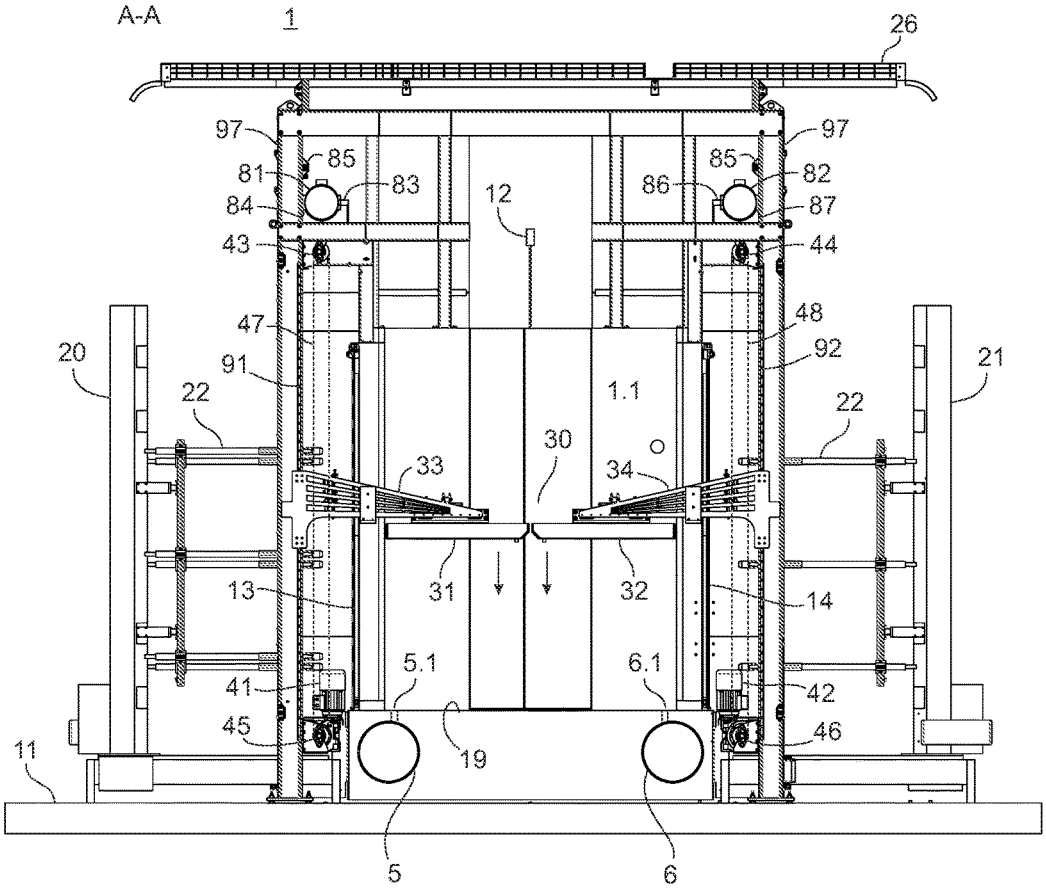
FIG. 4 shows the powder coating booth according to the invention in front view, in section, with the roof halfway lowered. The roof panels are in their inner positions.
Figure 5:
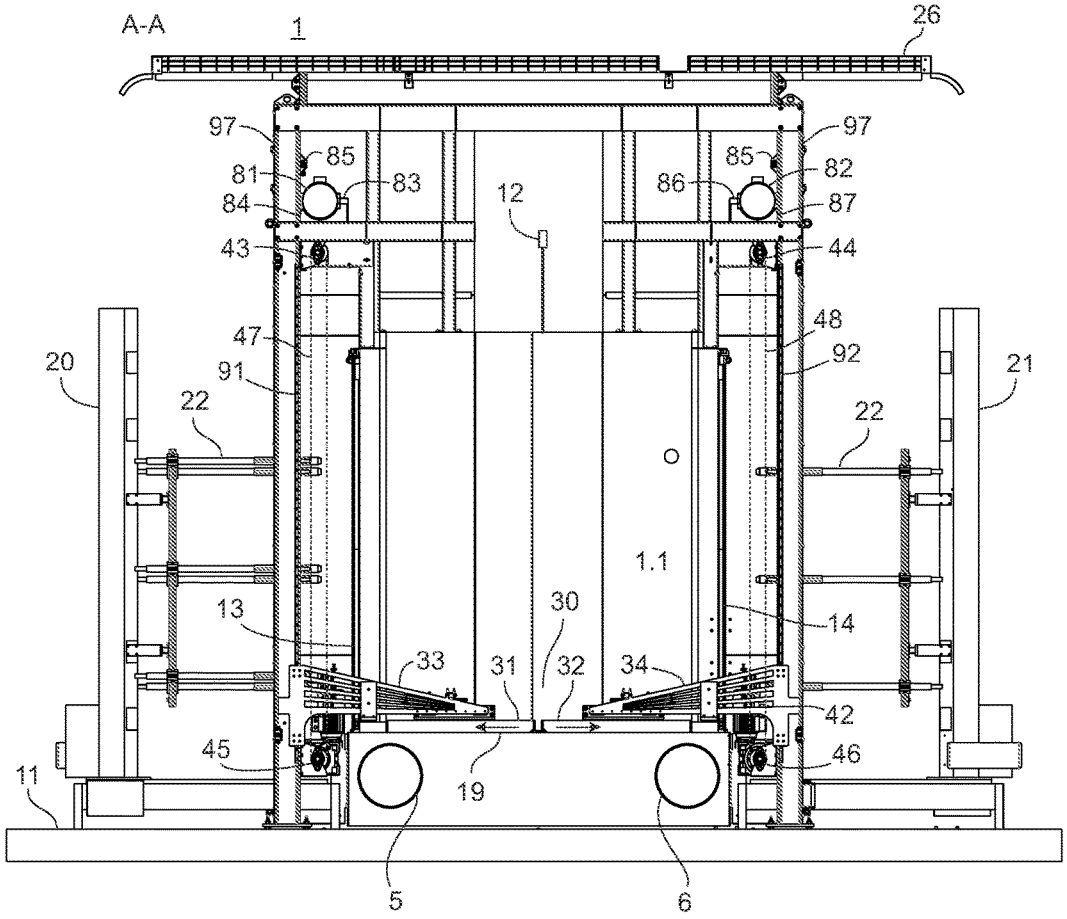
FIG. 5 shows the powder coating booth according to the invention in a front view, in section, with the roof lowered to the bottom. The roof panels have been moved outwards to the booth walls and form a gap between one another.
Figure 6:
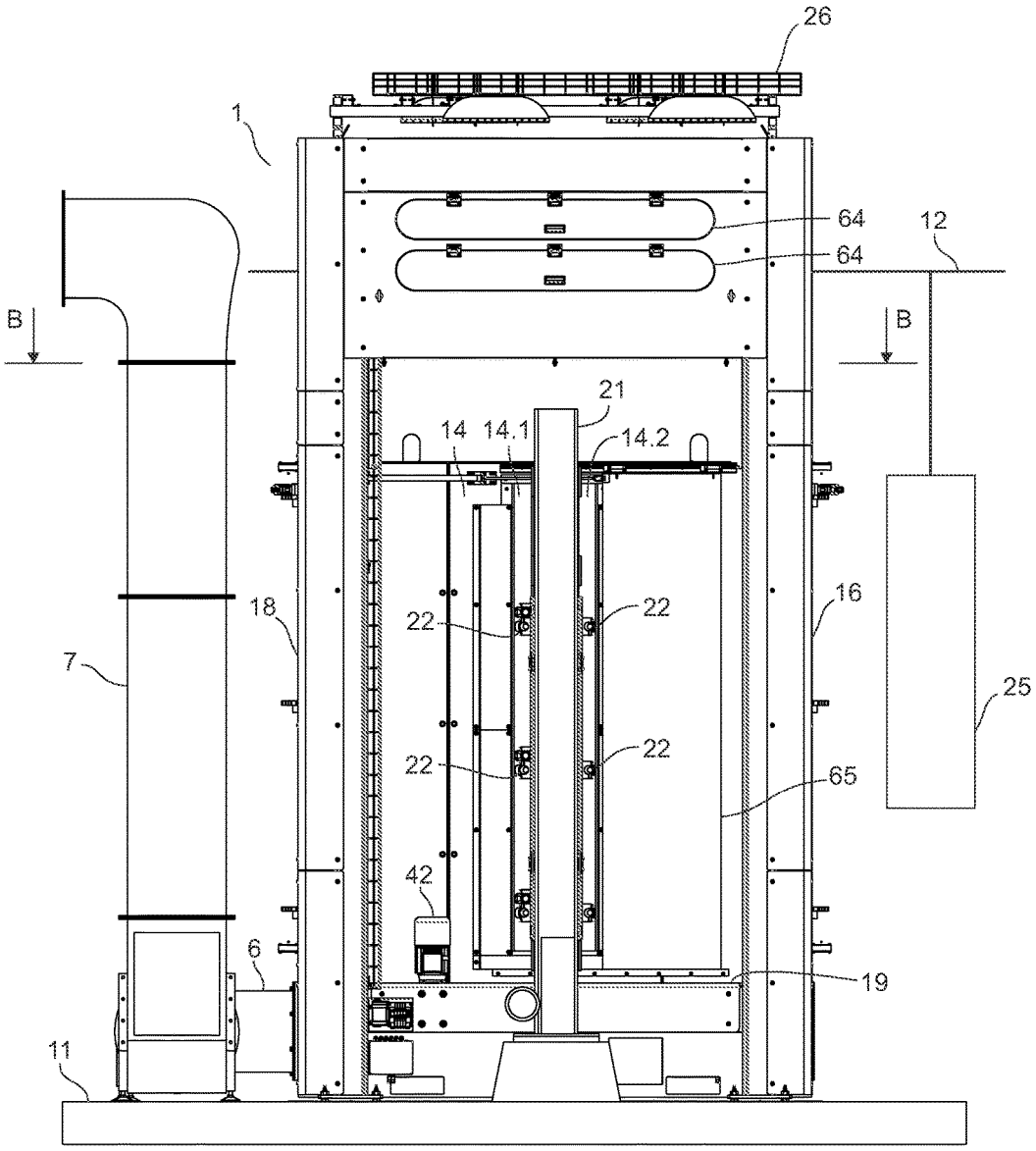
FIG. 6 shows a side view of the powder coating booth according to the invention.
Figure 7:
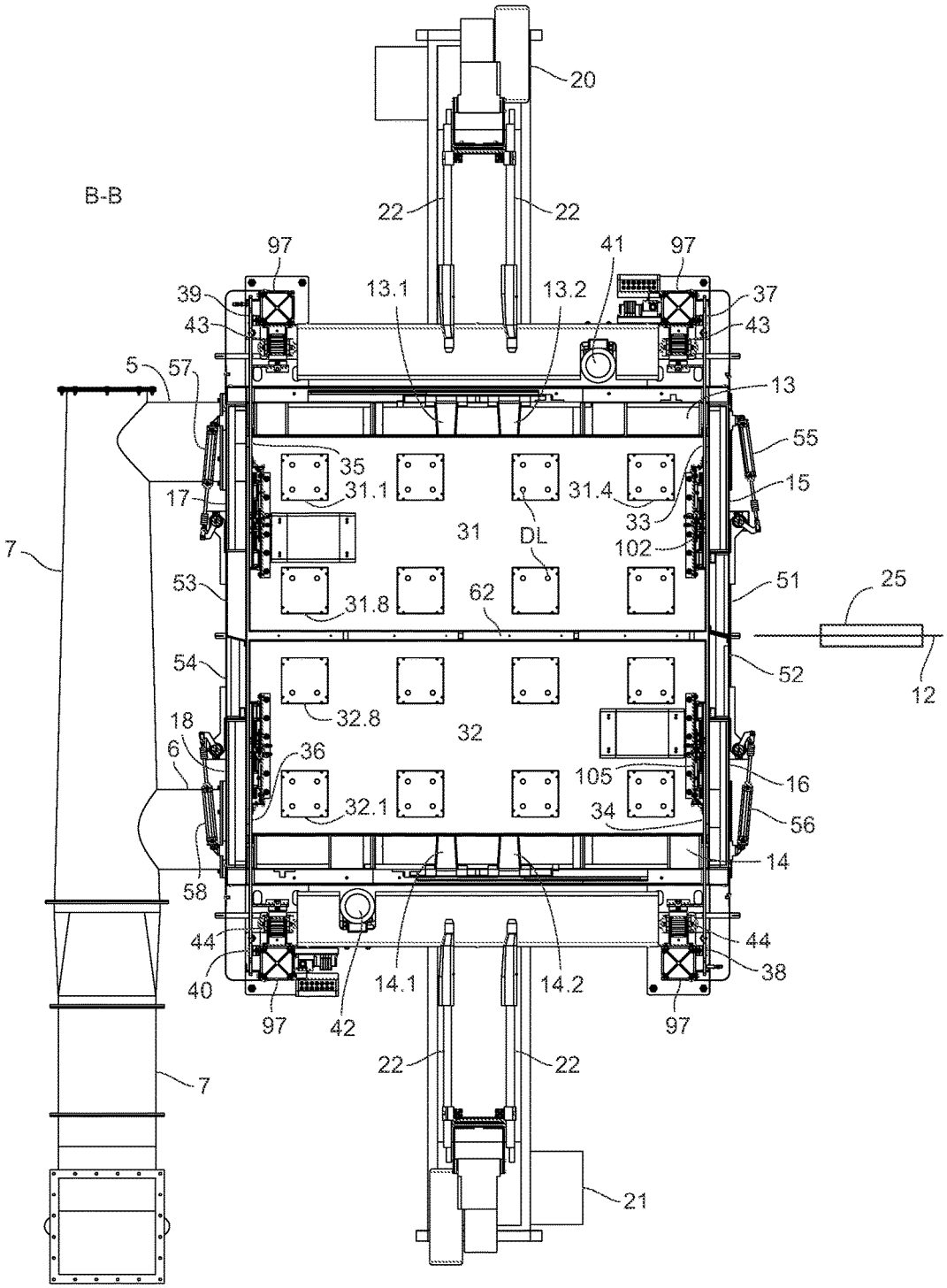
FIG. 7 shows the powder coating booth according to the invention in cross section from above.
Figure 8:
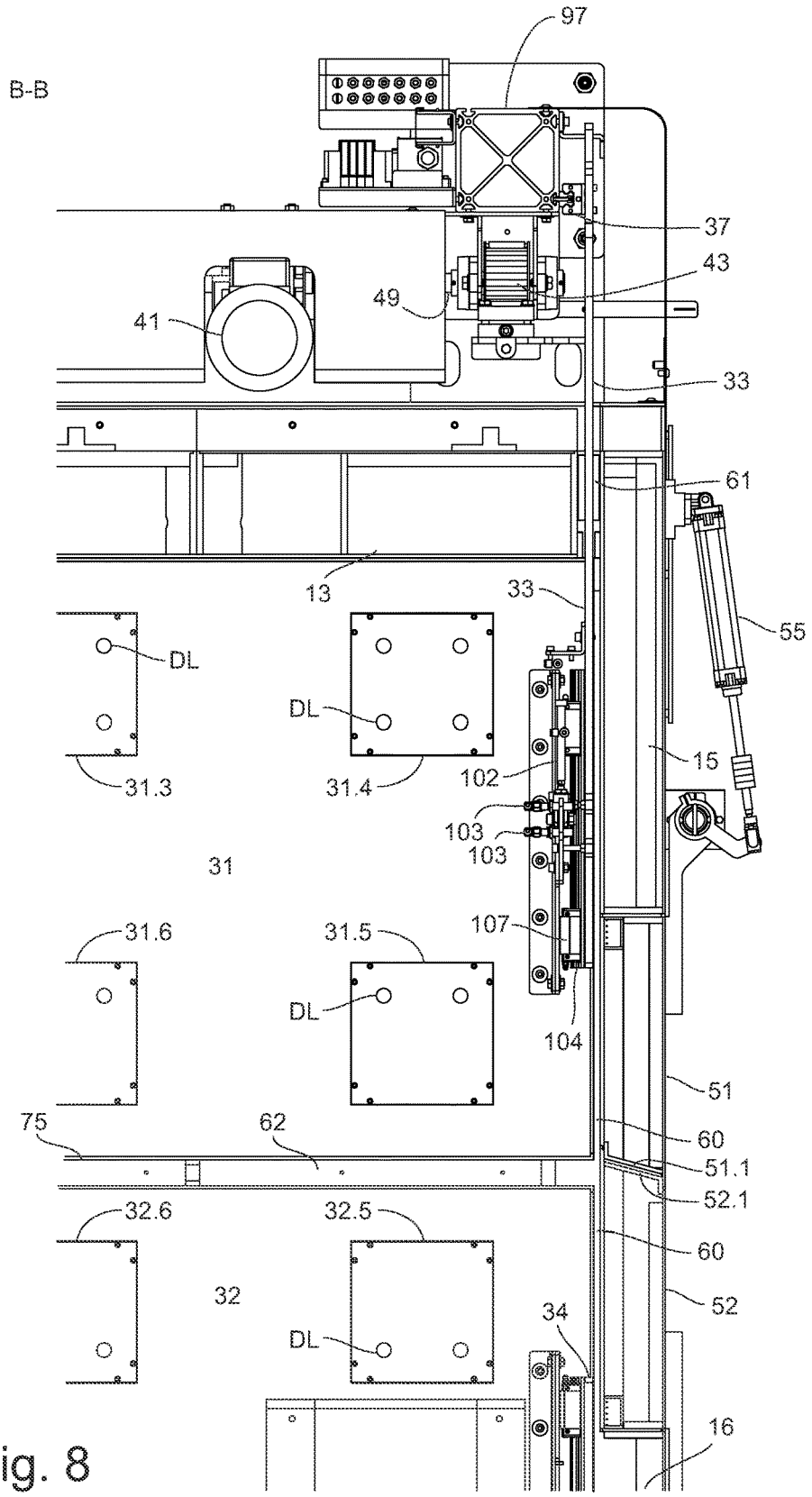
FIG. 8 shows an enlarged detail of the powder coating booth according to the invention in cross section.

In FIGS. 3, 4 and 5, a possible embodiment of the powder coating booth 1 according to the invention is shown in front view, in section. Booth 1 comprises a lowerable roof 30, which in FIG. 3 is located in the upper end position. In FIG. 4, roof 30 is lowered about halfway. In FIG. 5, roof 30 is in the lower end position. FIG. 6 shows powder coating booth 1 according to the invention in side view. FIG. 7 shows powder coating booth 1 according to the invention in cross section from above. The section runs along section line B-B. FIG. 8 shows an enlarged section of the powder coating booth according to the invention in cross section.

Roof 30 may comprise a first roof panel 31 and a second roof panel 32. The first roof panel 31 and the second roof panel 31 are planar components that are relatively thin, based on their area. They are supported by a supporting device, wherein the supporting device may have four supporting arms 33, 34, 35 and 36. The two supporting arms 33 and 35 support the first roof panel 31 and the two supporting arms 34 and 36 support the second roof panel 32. The supporting device is guided via vertical guides 37, 38, 39 and 40. Guides 37, 38, 39 and 40 are located on the outside of booth 1. In a booth quadrangular in cross section, guides 37, 38, 39 and 40 are preferably located in the corners of booth 1 (see FIG. 7). However, this is not mandatory. A correspondingly similar construction can also be realized in a booth cylindrical in cross-section. Vertical guides 37, 38, 39 and 40 are arranged so that they are suitable for guiding supporting arms 33 to 36.

Each of guides 37, 38, 39 and 40 may be attached to a pillar 97. In the embodiment shown in the figures, pillars 97 are located in the corners of booth 1.

Each of the supporting arms 33 to 36 protrudes into booth interior 1.1 through a correspondingly formed slot 61 in the booth wall (see FIG. 8). For this purpose, for example, booth side wall 13 may have such a slot 61 at each of its front ends. Booth wall 14 may also have such a slot 61 at each of its front ends. The width of the slots 61 may be selected so that supporting arms 33 to 36 are movable up and down without touching booth walls 13 and 14, respectively.

The supporting device can be moved up and down via a drive 41 and a drive shaft 49. Drive 41 and drive shaft 49 are preferably located in the lower region of booth 1. It is also advantageous to arrange drive shaft 49 on the longitudinal side on the outside of booth side wall 13 of booth 1. This has the advantage that no powder deposits on drive 41 and drive shaft 49. On the output side, the drive shaft 49 is connected to a gear 45. In the upper region of booth 1 there is another gear 43 above gear 45. Supporting arm 37 is attached to chain 47 which runs on the two gears 43 and 45.

Figure 15:
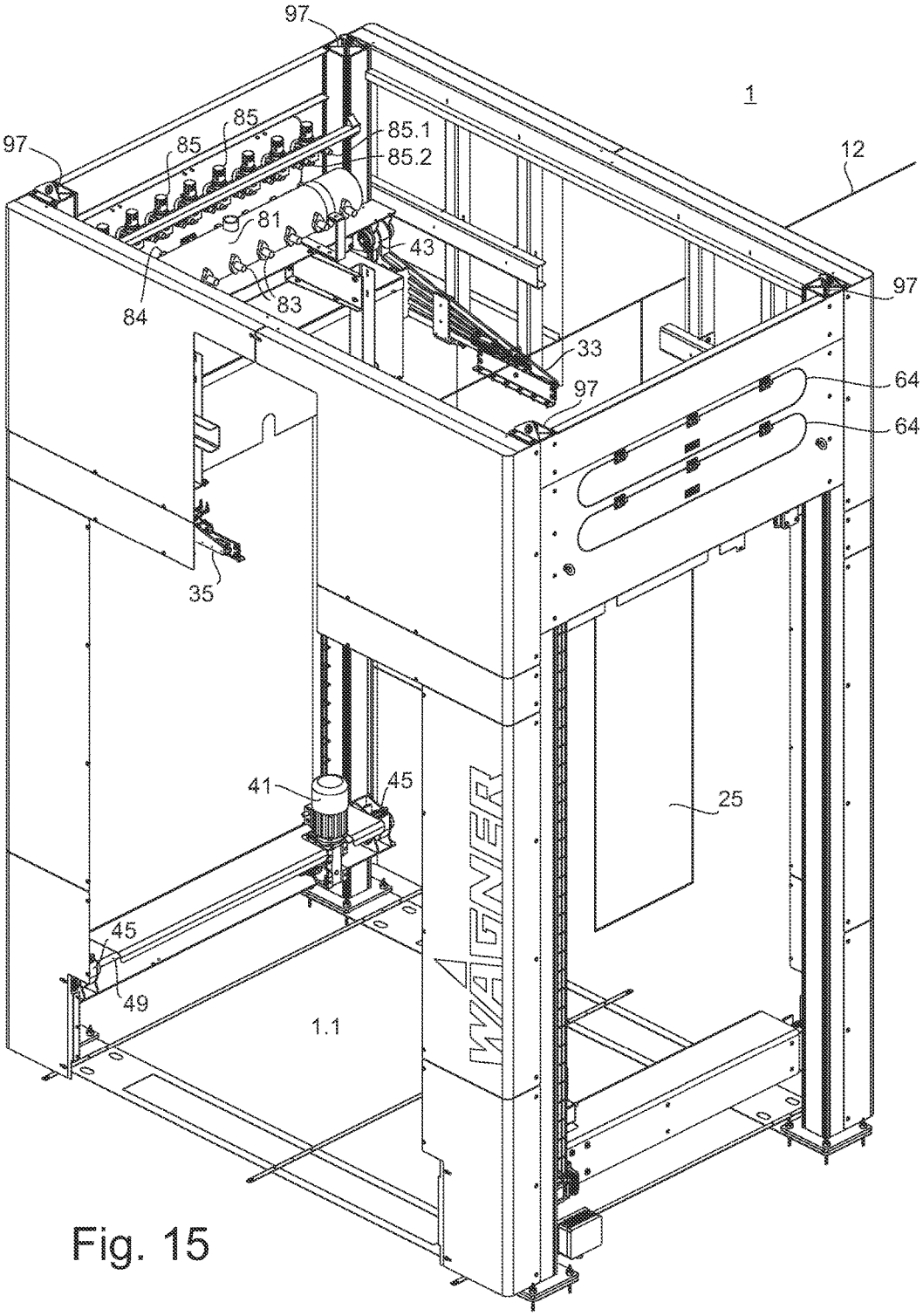
FIG. 15 shows a few components of the powder coating booth according to the invention in three-dimensional view.

As shown in FIG. 15, drive shaft 49 may be connected at its both ends with one gear 45 each. In this case, drive 41 drives the two gears 45 via drive shaft 49. In the upper region of booth 1 there is another gear 43 above each of the two gears 45. In the left corner of the booth chain 47 runs on the two gears 43 and 45, in the right corner of the booth a chain 48 runs on the two other gears 43 and 45. Supporting arm 33 is attached to chain 48. Analogously, the same structure is on the second longitudinal side/side wall 14 of booth 1. There also is a drive 42 which drives a shaft and two gears 46. Supporting arms 34 and 36 are moved up and down by two more chains running above on one gear each.

The embodiment shown has the advantage that only one drive 41, 42 is required per roof panel 31, 32. The drives 41 and 42 may be electric motors, for example.

If ropes, belts or toothed belts are used instead of the chains, pulleys 42, 43, 44 and 45 can also be used instead of the gears.

Pillars 97 and struts extending between the pillars form the basic structure of booth 1. The basic structure can also have sheets, plates, panels or the like and elements for lining, which are attached to the pillars and/or to the struts. Some of these are shown in FIG. 15.

In the upper region of booth 1, a compressed air pressure tank 81 which is attached to the basic structure of booth 1 is located on side wall 13. In addition, there are eight valves 84 and eight pressure regulators 85. The outlet of the compressed air pressure tank 81 is connected to each of the eight valves 84. Outlets 83 of the eight valves 84 in turn are each connected to the corresponding compressed air inlet 85.1 of the eight pressure regulators 85 via a compressed air line not shown in the figures. Outlets 85.2 of the eight pressure regulators 84 are connected with eight compressed air connections 31.1 to 31.8 of roof panel 31 via compressed air lines. The air pressure in each of the compressed air lines leading to the eight roof panel compressed air connections 31.1 to 31.8 can be adjusted separately by means of the eight pressure regulators 85.

In the upper region of the booth 1, a further compressed air pressure tank 82, which is also attached to the basic structure of booth 1, is located on side wall 14 opposite to side wall 13. In addition, eight valves 87 and eight pressure regulator 85 are arranged there. The compressed air pressure tank 82 serves to supply roof panel 32 with compressed air and can be built identically to compressed air pressure tank 81. The outlet of compressed air pressure tank 82 is connected to the eight valves 87. Each of the valve outlets 86 is connected to one of the compressed air inlets of pressure regulators 85 via a compressed air line. The outlets of the eight pressure regulators 85 are connected to eight compressed air connections 32.1 to 32.8 of roof panel 32 via compressed air lines not shown. The air pressure in each of the compressed air lines leading to the eight roof panel compressed air connections 32.1 to 32.8 can be adjusted separately by means of the eight pressure regulators 85.

Alternatively, the compressed air tanks 81 and 82 and the associated pressure regulators and valves may also be installed on roof 30.

The above-mentioned compressed air lines may be formed as tubes, for example. Valves 84 and 87 can be controlled with compressed air or electrically via control 110. Control 110 is preferably configured so that each of the total of 16 valves 84 and 87 can be controlled separately and thus each valve can be opened or closed separately.

Figure 10:
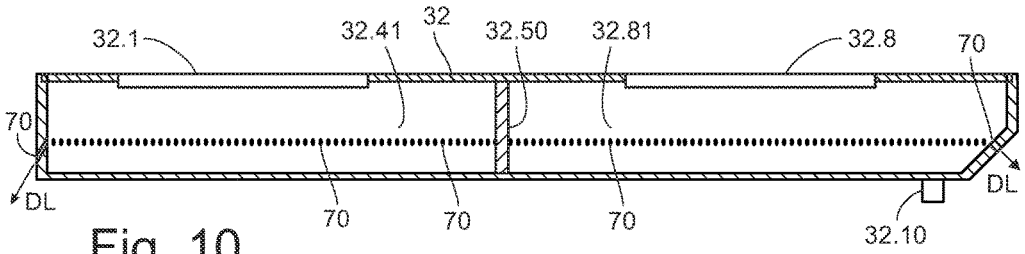
FIG. 10 shows the roof in side view, in section.

Each of the connections 32.1 to 32.8 in roof panel 32 is connected to a certain number of nozzles 70 via a compressed air duct 32.41 to 32.81 in order to be able to provide them with compressed air (FIG. 10). In order to form the compressed air ducts 32.41 to 32.81, corresponding dividing walls 32.50 are provided in the interior of roof panel 32. Instead, compressed air ducts 32.41 to 32.81 can also be formed by compressed air tubes. The same applies correspondingly to roof panel 31.

Nozzles 70 are arranged on the side surfaces of roof panels 31 and 32 (see FIGS. 9 to 12). The compressed air lines are in roof panels 31 and 32. Thus, for example, connection 32.1 supplies nozzles 70 in the left corner region of roof panel 32, and connection 32.4 supplies nozzles 70 in the right corner region. Nozzles 70 are thus divided into eight groups, wherein each of the groups can be pressurized separately with compressed air.

The number of pressure regulators, valves, connections and groups of nozzles is not limited to eight, rather should serve as an example. The number can also be higher or lower.

Figure 12:
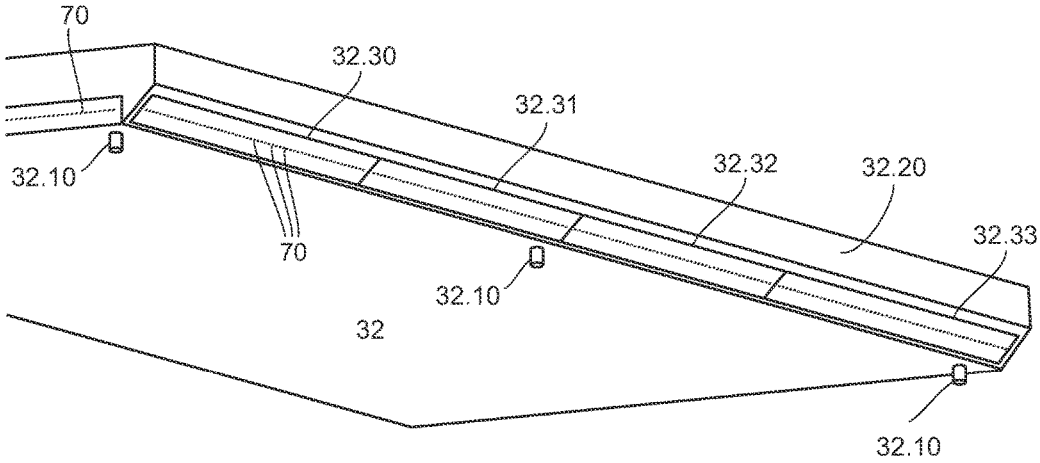
FIG. 12 shows an enlarged detail of the roof in three-dimensional view.

As can be seen from FIG. 12, nozzles 70 can be arranged on the longitudinal side of roof panel 32 in four groups 32.30 to 31.33, for example. Each of the groups can be supplied separately with compressed air, if required.

The solution according to the invention has the advantage that the space required for the mechanics for lowering roof 30 above the roof is kept to a minimum. Even if lowerable roof 30 is in its uppermost position, it does not protrude or only slightly beyond the upper edge of the booth. This has the advantage that the entire space above booth 1 is available for cable ducts 26, for example.

As shown in the embodiment according to FIG. 3, an air blow strip 75 may be arranged in the center of bottom 19, which air blow strip 75 is supplied with compressed air via compressed air lines not shown. In one embodiment of the invention, suction lines 5 and 6 are located below the booth bottom 19 and have suction openings 5.1 and 6.1, respectively. Suction opening 5.1 is located in the booth bottom 19 and connects booth interior 1.1 to suction line 5. Suction opening 6.1 is also located in the booth bottom 19 and connects booth interior 1.1 to suction line 6. Suction openings 5.1 and 6.1 can be slot-shaped and run in parallel to side walls 13 and 14. Using air blow strip 75 arranged on bottom 19, compressed air can be blown preferably parallel to bottom 19 in the direction of suction openings 5.1 and 6.1. In this way, bottom 19 and, if necessary, the underside of roof 30 can be freed from excess powder.

Air blow strip 75 may consist of several blow strip sections and extend over the entire length of bottom 19. It can be provided that each of the blow strip sections can be pressurized with compressed air by its own control valve. It can also be provided that a separate compressed air tank is present for the supply of blow strip 75. Controlling the valves is preferably carried out with control 110, which is connected to the valves via corresponding control lines.

If the individual valves for blow strip 75 are opened and closed sequentially, the individual sections of blow strip 75 are activated in the order in which the valves are actuated, and the floor or roof 30 is correspondingly blown off and cleaned in section by section. This has the advantage that the total compressed air consumption required per unit of time can be reduced. In addition, this reduces the noise level during the cleaning of floor 4 and roof panels 31 and 32.

Figure 11:
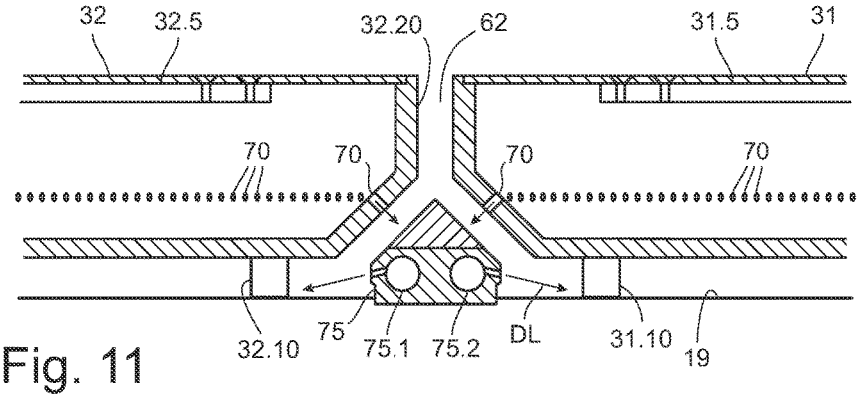
FIG. 11 shows an enlarged section of the roof resting on the booth bottom in front view, in section.

In FIG. 11, blow strip 75 is shown in front view. In principle, all blow strip sections can have the same structure. As shown in FIG. 11, blow strip 75 may have two air ducts 75.1 and 75.2, which are closed at the end of the blow strip section. Transverse to air ducts 75.1 and 75.2, the air blow strip sections have drilled holes which form the nozzles for the air outlet. Publication EP 1 466 670 B1 discloses the construction of such a blow strip for the bottom. The content of this publication is hereby incorporated in this application.

For cleaning booth 1, the coating operation is switched over to the cleaning operation. For this purpose, it is first ensured that no workpiece 25 is present in booth interior 1.1. Powder applicators 22 are moved out of booth interior 1.1, so that the booth interior 1.1 is free of obstacles. While powder applicators 22 are being moved out of booth 1, they may be blown off with compressed air nozzles 71 located in or on booth sidewalls 13 and 14 (see FIGS. 13 and 14).

Figure 8A:
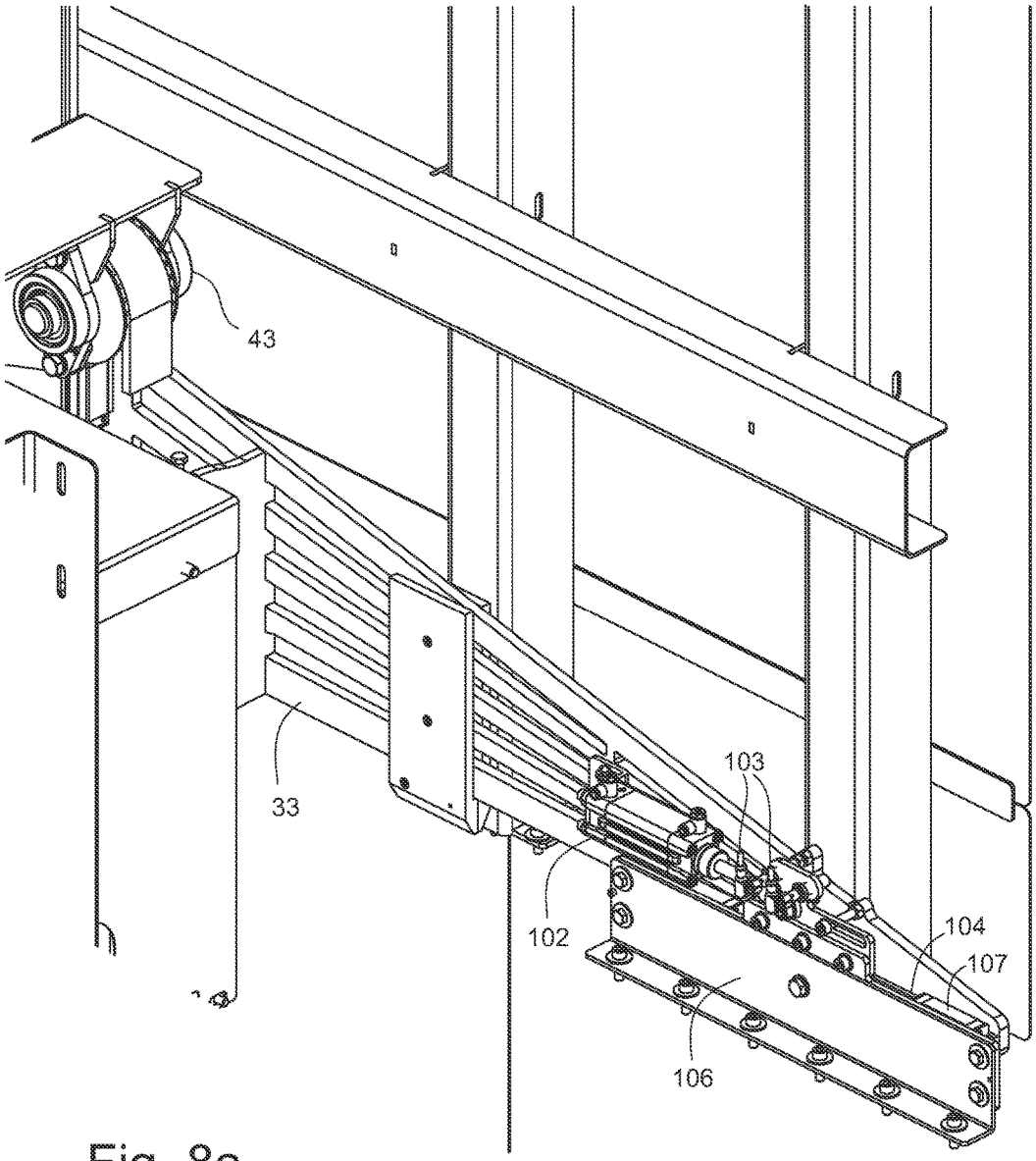
FIG. 8*a* shows an enlarged section of a supporting arm for supporting the roof.
Figure 9:
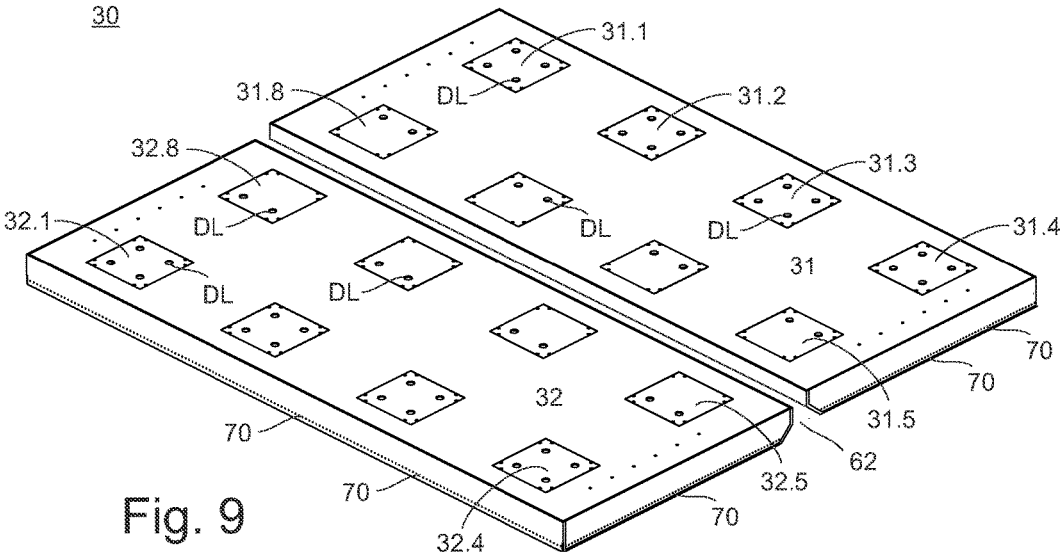
FIG. 9 shows a possible embodiment of the roof in three-dimensional view.

In a further step (see FIG. 3), the transport gap 62 between the two roof panels 31 and 32 is reduced or completely closed by the two roof panels 31 and 32 being moved horizontally toward each other as indicated by the two arrows in FIG. 3. The movement of roof panels 31 and 32 can be done by means of drives 102 and 105. Drives 102 and 105 may be configured as compressed air cylinders and actuated via compressed air connections 103. As can be seen from FIGS. 8 and 8*a*, roof panel 31 is attached horizontally movable to supporting arm 33 via a mounting bracket 106. For this purpose, a guide rail 104 is provided on the supporting arm 33, and two guide shoes 107 are provided at the mounting bracket 106. The same structure is also found on supporting arm 35. The roof panel 31 can be moved back and forth by the compressed air cylinders 102 attached to both supporting arms 33 and 35. The same applies correspondingly to roof panel 32. Only one compressed air cylinder 102 and 105, respectively, per roof panel may be sufficient.

In order to prevent powder from entering the environment during the cleaning operation, doors 65 for the powder applicators (FIG. 6) and doors 15, 16, 17 and 18 for workpieces 25 (FIG. 7) can be closed. If the booth also has a manual coat stand, the opening for manual coating can also be closed.

In a further step, compressed air is blown in the direction of the side walls 13-18 through nozzles 70 on roof panels 31 and 32. As a result, the region of side walls 13-18, which is hit by the compressed air, is cleaned. Subsequently, roof 30 is lowered (see FIG. 4) while continuing to blow compressed air in the direction of side walls 13-18. When roof 30 has arrived at booth bottom 19, compressed air DL is blown between bottom 19 and the undersides of roof panels 31 and 32 by means of blow strip 75. In order to maintain a certain distance between roof 30 and bottom 19, spacers 31.10 and 32.10 can be provided on the undersides of roof panels 31 and 32.

In order to further improve the cleaning effect on bottom 19, roof panels 31 and 32 can again be moved horizontally away from one another until they contact booth side walls 13 and 14 or form a minimum gap with booth side walls 13 and 14, respectively. Thus, the entire intake air flows through the air gap which exists between the underside of roof 30 and booth bottom 19 (FIG. 11).

If necessary, nozzles 70 can still spray compressed air even when roof 30 has arrived in its lower end position. As a result, the cleaning effect in the bottom region can be enhanced.

Preferably, the air is suctioned out of inside 1.1 of the booth via the two suction openings 5.1 and 6.1 and the suction lines 5 and 6 during the entire cleaning operation by means of cyclone separator 2.

Figure 13:
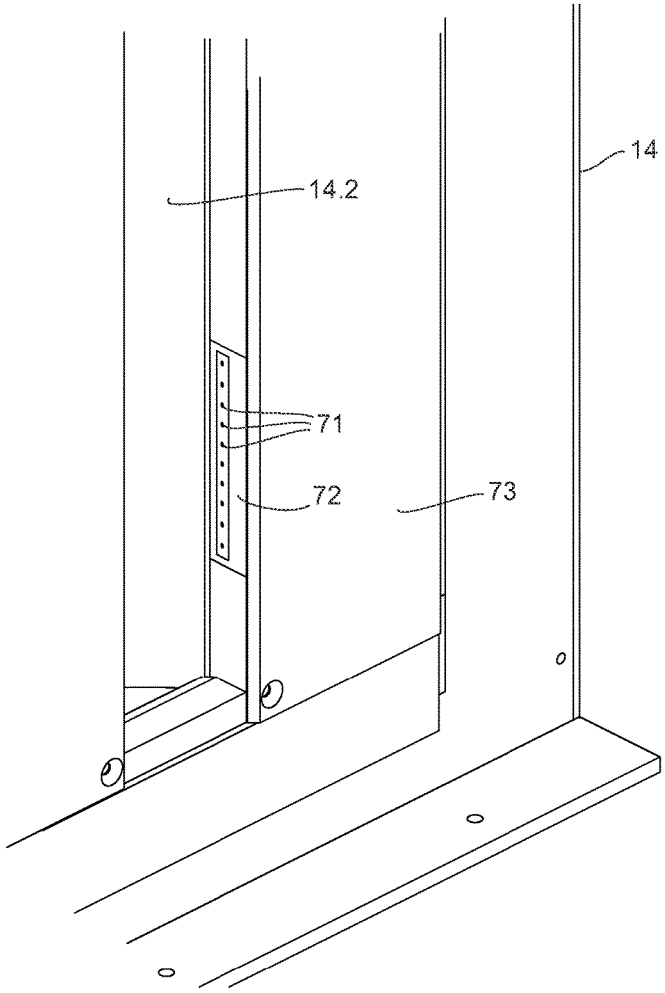
FIG. 13 shows an enlarged section of a side wall of the booth in three-dimensional view.
Figure 14:
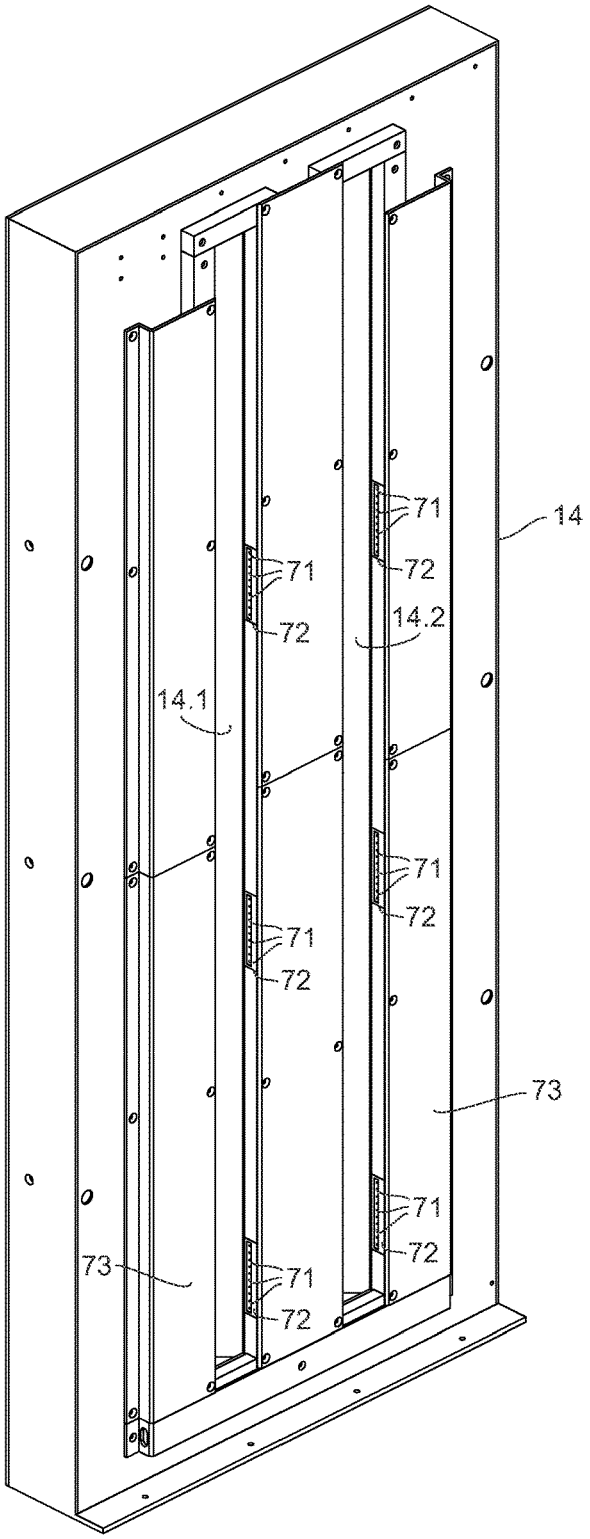
FIG. 14 shows the side wall of the booth in three-dimensional view.

In addition to the possibilities described above for blowing off booth walls 13-18 and bottom 19, nozzles 71 for blowing off powder applicators 22 may be provided in side walls 13 and/or 14. FIG. 14 shows side wall 14 of booth 1 with several blow strips 72 and nozzles 71 in three-dimensional view. FIG. 13 shows an enlarged section of side wall 14 in three-dimensional view. Here too, as already described above, several of nozzles 71 can be combined to form a group and several of such groups can be present. If necessary, each of the groups can be controlled separately by control 110. In this way, a group of nozzles, when it is not needed, can be switched off and so compressed air can be saved. Advantageously, one group each corresponds to one blow strip 72.

The same applies correspondingly to side wall 13, if there are passages for powder applicators.

The compressed air lines, which supply nozzles 71 with compressed air, can be laid on booth wall 14 behind a cover 73. This has the advantage that in this way the compressed air lines can be kept free of powder.

In addition, one or more sliding doors 65 may be provided, as shown in FIG. 6. The sliding door(s) 65 can be used to close passage openings 14.1 and 14.2 in booth wall 14. This is helpful, for example, during the cleaning operation. It prevents the powder-air mixture from escaping booth 1 through passages 14.1 and 14.2. The same applies correspondingly to opposite side wall 13.

Rather than sliding doors 65, hinged doors can be used instead. Each door can have a drive to be able to automatically close and open it. Each door can also have two drives; one drive to close the door and one drive to open the door.

It is also advantageous if the two openings on the front sides of booth 1, which are provided for workpiece transport, can be closed. This is particularly useful in cleaning operation, because it prevents the powder-air mixture from escaping through the openings. This can be done with doors 15, 16 and 17, 18 which are attached there. In FIG. 7, the doors 15 to 18 are shown in the closed state. Doors 15 to 18 can be opened and closed by means of drives 55 to 58. Drives 55 to 58 can be configured as compressed air cylinders and can be controlled by control 110. Compressed air nozzles can also be arranged on side surfaces 51.1 and 52.1, which are directly opposite when the doors 51 and 52 are closed. In principle, compressed air nozzles for blowing off can be provided on all side surfaces of doors 51 and 52. The same applies correspondingly to the two doors 53 and 54.

The two booth openings for workpiece 25 can be closed with only one door each instead of two doors each (see FIG. 7). The doors can be sliding doors or hinged doors.

In the upper region of booth 1, one or more flaps 64 can be arranged above side wall 14. If flaps 64 are opened, pressure tank 82, valves 87 and the pressure regulators are easily accessible through the openings. In order to facilitate access to pressure tank 81, valves 84 and pressure regulators 85, one or more flaps may also be provided above booth side wall 13.

The foregoing description of the exemplary embodiments of the present invention is for illustrative purposes only, and not for the purpose of limiting the invention. Within the scope of the invention, various changes and modifications are possible. Thus, for example, the various components of the powder coating booth shown in FIGS. 1 to 15 can also be combined with one another in a different way than shown in the figures. The components of coating installation 100 shown in FIGS. 1 and 2 can also be arranged differently than shown.

LIST OF REFERENCE NUMERALS

1 Powder coating booth
1.1 Spray coating space of the booth/booth interior
2 Cyclone separators
2.1 Suction inlet
2.2 Outlet
2.3 Powder outlet
3 Powder center
4 Post filters
5 Suction line
5.1 Suction opening
6 Suction line
6.1 Suction opening
7 Suction line
8 Suction line
9 Suction line
10 Suction line
11 Bottom
12 Conveyors
13 Booth side wall
13.1 Opening in the booth side wall
13.2 Opening in the booth side wall
14 Booth side wall
14.1 Opening in the booth side wall
14.2 Opening in the booth sidewall
15 Booth wall
16 Booth wall
17 Booth wall
18 Booth wall
19 Booth bottom
20 Linear lifter
21 Linear lifter
22 Powder spray applicator
25 Workpiece
26 Cable duct
30 Roof
31 Roof panel
31.1 Compressed air connection
31.2 Compressed air connection
31.3 Compressed air connection
31.4 Compressed air connection
31.5 Compressed air connection
31.8 Compressed air connection
31.10 Spacers
32 Roof panel

32.1-32.8 Compressed air connections
32.10 Spacer
32.20 Side surface of the roof panel
32.30-32.33 Segments with compressed air nozzles
32.41 Compressed air duct
32.50 Dividing wall
32.81 Compressed air duct
33 Supporting arm
34 Supporting arm
35 Supporting arm
36 Supporting arm
37 Vertical guide
38 Vertical guide
39 Vertical guide
40 Vertical guide
41 Drive/motor
42 Drive/motor
43 Pulley/gear
44 Pulley/gear
45 Pulley/gear
46 Pulley/gear
47 Chain
48 Chain
49 Drive shaft
51 door
51.1 Side surface of the door
52 Door
52.1 Side surface of the door
53 Door
54 Door
55 Pneumatic cylinders
56 Pneumatic cylinders
57 Pneumatic cylinders
58 Pneumatic cylinders
60 Gap
61 Slot
62 Gap
64 Flap
65 Sliding door
70 Nozzle
71 Nozzle
72 blow strip
73 Cover
75 Blow strip
75.1 Air duct
75.2 Air duct
81 Compressed air tank
82 Compressed air tank
83 Compressed air outlet
84 Valve
85 Pressure regulator
85.1 Compressed air inlet
85.2 Compressed air outlet
86 Compressed air outlet
87 Valve
91 Guide
92 Guide
97 Pillar
100 Powder coating installation
102 Compressed air cylinder
103 Compressed air connections
104 Guide rail
105 Compressed air cylinder
106 Mounting bracket
107 Guide shoe
110 Control
DL Compressed air

The invention claimed is:

1. A powder coating booth, comprising, booth walls and a roof which can be lowered between the booth walls, wherein a gap is provided between the roof and the booth walls, a powder spray applicator for powder spray coating a workpiece in the powder coating booth;

compressed air nozzles for blowing compressed air on the booth walls to remove powder overspray from the booth walls, in which the compressed air nozzles are provided at the roof, a supporting that carries the roof, wherein a vertical slot is provided in at least one of the booth walls and the support protrudes through the vertical slot into the booth, wherein the support is configured to move up and down in a vertical direction within the vertical slot, such that the roof moves up and down in the vertical direction with the support;

wherein a bottom of the booth is provided with a suction, and wherein the suction is connectable with a suction inlet of a cyclone separator via a suction pipe.

2. The booth according to claim 1, wherein the booth walls at least partially define an interior spray coating space of the booth, and wherein a vertical guide is arranged outside the spray coating space, the vertical guide extending in the vertical direction between a top of the booth and the bottom of the booth, wherein the vertical guide is configured to guide the support as the support moves up and down in the vertical direction within the vertical slot.

3. The booth according to claim 1, wherein the vertical slot is arranged in a corner of the booth.

4. The booth according to claim 1, wherein the roof has a first roof panel and a second roof panel, wherein at least one of the roof panels is horizontally movable.

5. The booth according to claim 1, wherein the compressed air nozzles are divided into several groups, and wherein the groups are independently operable.

6. The booth according to claim 5, wherein a drive is provided, by which the first roof panel is horizontally movable.

7. The booth according to claim 1, wherein a motor is provided, by which the roof is vertically movable.

8. The booth according to claim 1, wherein a passage for the powder spray applicator is arranged in one of the booth walls, wherein the spray applicator passage is arranged in the booth wall such that it is at the largest possible distance to the slot.

9. The booth according to claim 1, wherein compressed air nozzles are provided in at least one of the booth walls, wherein their blowing direction is directed at the spray applicator passage.

10. The booth according to claim 8, wherein a sliding door is provided, by which the spray applicator passage can be closed.

11. The booth according to claim 1, wherein a door is provided on a front side of the booth, in which compressed-air nozzles are arranged.

12. The booth according to claim 1, wherein a blow strip with several compressed air nozzles is arranged at the bottom of the booth.

13. The booth according to claim 12, wherein the compressed air nozzles of the blow strip are divided into several sections, and wherein the sections are independently operable.

14. A powder coating installation, comprising:

the powder coating booth according to claim 1, and a cyclone separator which is connected to the powder coating booth.

15. A method for cleaning a powder coating booth, comprising:

providing the powder coating booth according to claim 1, cleaning the booth walls by blowing compressed air on the booth walls with the compressed air nozzles provided at the roof; and moving the roof vertically via the support;

wherein the support protrudes through the vertical slot into the booth and carries the roof, and during the moving the roof vertically via the support, the support moves vertically within the vertical slot; and wherein the roof has a first roof panel and a second roof panel, and a gap between the first and second roof panels is closed before the cleaning of the booth walls.

16. The method according to claim 15, wherein the moving the roof vertically includes moving the roof downwards from a top of the booth to the bottom of the booth, and wherein during the moving the roof downwards, the compressed air nozzles blow compressed air on the booth walls.

17. The method according to claim 16, wherein, when the roof panels are at the bottom of the booth, the roof panels are moved away from one another in the direction of the booth walls so that a gap is formed between the roof panels.

18. The booth according to claim 1, wherein, the support is movable downward within the vertical slot to move the roof between the booth walls from a top of the booth to the bottom of the booth, and is movable upward within the vertical slot to move the roof between the booth walls from the bottom of the booth to the top of the booth.

* * * * *